US007313866B2

(12) United States Patent
Linn et al.

(10) Patent No.: US 7,313,866 B2
(45) **Date of Patent: *Jan. 1, 2008**

(54) SPRING ASSIST KNIFE

(75) Inventors: Eric Linn, El Cajon, CA (US); Paul Naranjo, Wildomar, CA (US); Paul Kassa, Santee, CA (US); Brandon Hatcher, Dallas, TX (US)

(73) Assignee: Buck Knives, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/344,470

(22) Filed: Jan. 31, 2006

(65) Prior Publication Data

US 2006/0123632 A1 Jun. 15, 2006

Related U.S. Application Data

(63) Continuation of application No. 10/774,310, filed on Feb. 6, 2004, now Pat. No. 7,107,686.

(60) Provisional application No. 60/445,244, filed on Feb. 6, 2003.

(51) Int. Cl.
*B26B 1/02* (2006.01)

(52) U.S. Cl. ..... 30/159; 30/160

(58) Field of Classification Search ..... 30/155, 30/156, 157, 158, 159, 160, 161
See application file for complete search history.

(56) References Cited

U.S. PATENT DOCUMENTS 23,975 A 5/1859 Belcher
57,902 A 9/1866 Hibbard
199,766 A 1/1878 Whitehouse (Continued)

FOREIGN PATENT DOCUMENTS

DE 28765 1/1884

(Continued)

OTHER PUBLICATIONS

*Blade* (Apr. 2000), p. 112.

(Continued)

*Primary Examiner*—Hwei-Siu C. Payer
(74) *Attorney, Agent, or Firm*—Townsend and Townsend and Crew LLP

(57) ABSTRACT

A spring assist folding knife and method of biasing a blade in a folding knife. The folding knife includes a blade, liner, and handle. The blade includes a first recess for receiving a pivot pin. The blade includes a second recess offset from the axis of rotation. A latch cam having an offset pin is located relative to the second recess. The liner includes an arcuate slot in which the offset pin of the latch cam is located. The arcuate slot within the liner or handle also includes a convex extension. A spring is configured to provide a force in the direction of blade opening and provides the force throughout the entire range of blade motion. The spring applies its force to the offset pin to bias the blade in the closed position until the blade reaches a predetermined angle. Then the spring biases the blade to the open position.

18 Claims, 18 Drawing Sheets

U.S. PATENT DOCUMENTS

| | | | |
|---|---|---|---|
| 226,910 | A | 4/1880 | Friebertshauser |
| 338,251 | A | 3/1886 | Crandall et al. |
| 382,967 | A | 5/1888 | Fullerton |
| 530,792 | A | 12/1894 | Nordlow |
| 551,052 | A | 12/1895 | Shonnard et al. |
| 552,928 | A | 1/1896 | Russell |
| 557,760 | A | 4/1896 | Brauer |
| 577,593 | A | 2/1897 | Bronson et al. |
| 600,442 | A | 3/1898 | Nell |
| 616,689 | A | 12/1898 | Ruettgers |
| 749,230 | A | 1/1904 | Severance |
| 777,358 | A | 12/1904 | Weck |
| 825,976 | A | 7/1906 | Neiglick |
| 845,792 | A | 3/1907 | Jenkins |
| 969,909 | A | 9/1910 | Schrade et al. |
| 1,057,525 | A | 4/1913 | Bruecker |
| 1,090,416 | A | 3/1914 | Roth |
| 1,189,005 | A | 6/1916 | Seely |
| 1,315,503 | A | 9/1919 | Hughes |
| 1,319,532 | A | 10/1919 | Rasmussen |
| 1,357,398 | A | 11/1920 | Haywood |
| 1,412,373 | A | 4/1922 | Shields |
| 1,417,872 | A | 5/1922 | Wall |
| 1,431,835 | A | 10/1922 | Neft |
| 1,440,793 | A | 1/1923 | Rasmussen |
| 1,454,665 | A | 5/1923 | Bobek |
| 1,496,188 | A | 6/1924 | Wall |
| 1,515,688 | A | 11/1924 | Love |
| 1,584,165 | A | 5/1926 | Brown |
| 1,603,914 | A | 10/1926 | Hermann |
| 1,614,949 | A | 1/1927 | Finley |
| 1,701,027 | A | 2/1929 | Brown |
| 1,738,496 | A | 12/1929 | Laux |
| 1,743,022 | A | 1/1930 | Carman |
| 1,810,031 | A | 6/1931 | Schrade |
| 1,864,011 | A | 6/1932 | Brown |
| 2,284,168 | A | 5/1942 | Rickenbacher |
| 2,286,524 | A | 6/1942 | Wilbur |
| 2,304,601 | A | 12/1942 | Schrade |
| D137,408 | S | 3/1944 | Frisk |
| 2,407,897 | A | 9/1946 | Newman |
| 2,455,765 | A | 12/1948 | Harvey |
| 2,569,080 | A | 9/1951 | Trimble et al. |
| 2,596,294 | A | 5/1952 | Schrade |
| 2,736,959 | A | 3/1956 | Simon et al. |
| 3,079,784 | A | 3/1963 | Pavlowski |
| 3,404,456 | A | 10/1968 | Chilko |
| 3,702,501 | A | 11/1972 | Wood |
| 3,868,774 | A | 3/1975 | Miori |
| 4,040,081 | A | 8/1977 | Ninomiya et al. |
| 4,133,106 | A | 1/1979 | Addis |
| 4,145,808 | A | 3/1979 | Walsh |
| 4,148,140 | A | 4/1979 | Lile |
| 4,173,068 | A | 11/1979 | Cargill |
| 4,211,003 | A | 7/1980 | Collins |
| 4,218,819 | A | 8/1980 | Phelps |
| 4,240,201 | A | 12/1980 | Sawby et al. |
| 4,268,960 | A | 5/1981 | Reinschreiber |
| 4,274,200 | A | 6/1981 | Coder |
| 4,322,885 | A | 4/1982 | Osada |
| 4,347,665 | A | 9/1982 | Glesser |
| 4,356,631 | A | 11/1982 | Guth |
| 4,389,775 | A | 6/1983 | Collins |
| 4,404,748 | A | 9/1983 | Wiethoff |
| 4,426,779 | A | 1/1984 | Morgan |
| 4,439,922 | A | 4/1984 | Sassano |
| 4,442,600 | A | 4/1984 | Felix-Dalichow |
| 4,451,982 | A | 6/1984 | Collins |
| 4,466,561 | A | 8/1984 | Slaughter |
| 4,481,712 | A | 11/1984 | Phelps |
| 4,494,309 | A | 1/1985 | Gray |
| 4,494,310 | A | 1/1985 | Slaughter |
| 4,502,221 | A | 3/1985 | Pittman |
| 4,525,928 | A | 7/1985 | Foster |
| 4,529,111 | A | 7/1985 | Hayakawa |
| 4,541,175 | A | 9/1985 | Boyd et al. |
| 4,541,556 | A | 9/1985 | Collins et al. |
| 4,551,917 | A | 11/1985 | Walker |
| 4,561,577 | A | 12/1985 | Moore |
| 4,570,341 | A | 2/1986 | Konneker |
| 4,600,133 | A | 7/1986 | Maihos |
| 4,604,803 | A | 8/1986 | Sawby |
| 4,612,706 | A | 9/1986 | Yunes |
| 4,670,984 | A | 6/1987 | Rickard |
| 4,719,700 | A | 1/1988 | Taylor, Jr. |
| 4,741,106 | A | 5/1988 | Yamagishi |
| 4,802,279 | A | 2/1989 | Rowe |
| 4,805,303 | A | 2/1989 | Gibbs |
| 4,805,819 | A | 2/1989 | Collins |
| 4,811,486 | A | 3/1989 | Cunningham |
| 4,837,932 | A | 6/1989 | Elsener |
| 4,848,000 | A | 7/1989 | O'Dell |
| 4,893,409 | A | 1/1990 | Poehlmann |
| 4,896,424 | A | 1/1990 | Walker |
| 4,909,424 | A | 3/1990 | Reynolds |
| 4,947,552 | A | 8/1990 | Barnes |
| 4,974,323 | A | 12/1990 | Cassady |
| 4,979,301 | A | 12/1990 | Walker |
| 5,044,079 | A | 9/1991 | Gibbs |
| 5,060,379 | A | 10/1991 | Neely |
| 5,092,045 | A | 3/1992 | Boyd, Jr. et al. |
| 5,095,624 | A | 3/1992 | Ennis |
| 5,111,581 | A | 5/1992 | Collins |
| 5,123,167 | A | 6/1992 | Kelley |
| 5,131,149 | A | 7/1992 | Thompson et al. |
| D333,251 | S | 2/1993 | Glesser |
| D336,602 | S | 6/1993 | Thompson et al. |
| 5,217,150 | A | 6/1993 | Chen |
| 5,217,151 | A | 6/1993 | Parsons |
| D338,386 | S | 8/1993 | Frazer |
| D345,289 | S | 3/1994 | Sakai |
| 5,293,690 | A | 3/1994 | Cassady |
| D345,688 | S | 4/1994 | McLean et al. |
| 5,325,588 | A | 7/1994 | Rogers |
| 5,331,741 | A | 7/1994 | Taylor, Jr. |
| 5,349,753 | A | 9/1994 | Gaffney |
| 5,361,497 | A | 11/1994 | Crawford |
| 5,400,509 | A | 3/1995 | Collins |
| 5,425,175 | A | 6/1995 | Rogers |
| 5,437,101 | A | 8/1995 | Collins |
| 5,450,670 | A | 9/1995 | Sakai |
| 5,461,786 | A | 10/1995 | Miller |
| 5,467,256 | A | 11/1995 | Chen |
| D365,266 | S | 12/1995 | Hasegawa |
| 5,495,674 | A | 3/1996 | Taylor, Jr. |
| 5,502,895 | A | 4/1996 | Lemaire |
| 5,515,610 | A | 5/1996 | Levin et al. |
| 5,537,750 | A | 7/1996 | Seber et al. |
| 5,546,662 | A | 8/1996 | Seber et al. |
| 5,689,885 | A | 11/1997 | Walston |
| 5,692,304 | A | 12/1997 | Campbell |
| 5,737,841 | A | 4/1998 | McHenry et al. |
| 5,755,035 | A | 5/1998 | Weatherly |
| 5,802,722 | A | 9/1998 | Maxey et al. |
| 5,815,927 | A | 10/1998 | Collins |
| 5,819,414 | A | 10/1998 | Marifone |
| 5,822,866 | A | 10/1998 | Pardue |
| 5,826,340 | A | 10/1998 | Hull |
| 5,839,194 | A | 11/1998 | Bezold |
| 5,887,347 | A | 3/1999 | Gibbs |
| 5,915,792 | A | 6/1999 | Sakurai |
| 5,964,036 | A | 10/1999 | Centofante |
| 5,979,065 | A | 11/1999 | Hsu |
| 6,079,106 | A | 6/2000 | Vallotton |

| | | | | |
|---|---|---|---|---|
| 6,145,202 | A | 11/2000 | Onion | |
| 6,154,965 | A | 12/2000 | Sakai | |
| 6,158,127 | A | 12/2000 | Taylor | |
| 6,212,779 | B1 | 4/2001 | Mitchell | |
| 6,308,420 | B1 | 10/2001 | Moser | |
| 6,338,431 | B1 | 1/2002 | Onion | |
| D454,043 | S | 3/2002 | Onion | |
| D454,768 | S | 3/2002 | Onion | |
| 6,363,615 | B1 | 4/2002 | Moser | |
| 6,378,214 | B1 | 4/2002 | Onion | |
| 6,397,476 | B1 | 6/2002 | Onion | |
| 6,427,334 | B2 | 8/2002 | Onion | |
| 6,430,816 | B2 | 8/2002 | Neveux | |
| 6,438,848 | B1 * | 8/2002 | McHenry et al. | 30/161 |
| 6,553,671 | B2 * | 4/2003 | Blanchard | 30/161 |
| 6,574,869 | B1 | 6/2003 | McHenry et al. | |
| 6,591,504 | B2 | 7/2003 | Onion | |
| 6,729,029 | B1 | 5/2004 | Chu | |
| 6,732,436 | B2 | 5/2004 | Moizis | |
| 6,959,494 | B2 * | 11/2005 | Taylor | 30/159 |
| 7,000,323 | B1 * | 2/2006 | Hatcher et al. | 30/155 |
| 2003/0070299 | A1 | 4/2003 | Frazer | |
| 2004/0244205 | A1 | 12/2004 | Linn et al. | |
| 2005/0072004 | A1 | 4/2005 | Carter, III | |

FOREIGN PATENT DOCUMENTS

| | | | |
|---|---|---|---|
| DE | 29469 | | 3/1884 |
| DE | 1104386 | | 4/1961 |
| EP | 0230000 | A1 | 7/1987 |
| FR | 1069862 | | 7/1954 |
| FR | 1171740 | | 1/1959 |
| FR | 1248117 | | 10/1960 |
| FR | 2705606 | | 12/1994 |
| JP | 3227601 | | 10/1991 |
| JP | 4030979 | | 2/1992 |
| JP | 5185381 | | 7/1993 |

OTHER PUBLICATIONS

*Blade* (Dec. 1998), pp. 5,96.

*Blade* (Feb. 1999), pp. 5ff, 87, 127.

*Blade* (Mar. 1999), pp. 5ff, 34-35ff, 74, 117, 151.

*Blade* (Apr. 1999), pp. 5ff, 12-14, 16ff, 31, 60-67.

*Blade* (May 1999), pp. 5ff, 23ff, 79-81, 86.

Lang, Bud "Trick" Knives, *Knives Illustrated* (Spring 1993), pp. 28-31.

Karwan, Chuck "Oregon Spring Steel", *Fighting Knives* (Spring 1992), pp. 43-46, 94.

* cited by examiner

SPRING ASSIST KNIFE

CROSS-REFERENCES TO RELATED APPLICATIONS

This application is a continuation of U.S. Utility application Ser. No. 10/774,310, filed Feb. 6, 2004, now U.S. Pat. No. 7,107,686 entitled SPRING ASSIST KNIFE, which claims the benefit under 35 USC § 119(e) of U.S. Provisional Application No. 60/445,244, filed Feb. 6, 2003, entitled SPRING ASSISTED KNIVES, both applications are herein incorporated by reference in their entirety.

BACKGROUND OF THE DISCLOSURE

1. Field of the Disclosure

The disclosure relates to knives. In particular, the disclosure relates to spring assisted folding knives.

2. Description of Related Art

Conventional spring assisted knives utilize a Cam-Over-Center design as shown in FIGS. 1 and 2. FIG. 1 shows a pin attached to a blade of a folding knife. The pin is secured to the blade in an off-center position. A bar under tension is applied to the pin as a blade driver. When the blade is unlocked from the liner and returned to the knife body, the user rotates the blade counterclockwise (CCW) direction, thereby closing the knife. Once the pin on the blade rotates past center, the cam action of the bar against the pin keeps the blade in the closed position.

When the user is ready to open a spring assisted knife, the user may use a thumb stud or some other feature on the blade to initiate blade movement. FIG. 2 illustrates how the blade is driven once the blade/pin are beyond center. When the knife is in the orientation shown in FIG. 2, the blade is rotated in a direction that is reverse from the CCW direction used to close the knife. Thus, a user rotates the blade in a clockwise (CW) direction to open the knife and the action is assisted by the bar under tension. Unimpeded, the blade should rotate to a fully locked position. However, the bar is limited by the amount of action it can apply to the blade because it does not follow the pin throughout its entire travel. Consequently the force applied to the blades in the prior designs are limited to 90° of blade rotation, at best.

BRIEF SUMMARY OF THE DISCLOSURE

A spring assist folding knife and method of biasing a blade in a folding knife are described and claimed herein. The folding knife can include a blade, liner, and handle. The blade can include a first recess for receiving a pivot pin. The blade can also include a second recess offset from the axis of rotation. A latch cam having an offset pin can be located relative to the second recess. The liner can include an arcuate slot in which the offset pin of the latch cam can be located. The arcuate slot within the liner or handle can also include a convex extension. A spring can be configured to provide a force in the direction of blade opening and can provide the force throughout the entire range of blade motion. The spring can apply its force to the offset pin to bias the blade in the closed position until the blade reaches a predetermined angle. Then the spring can exert a force to open the blade to a fully open position.

In one aspect the disclosure includes a folding knife including a reference piece having an arcuate slot with a convex extension slot positioned at one end of the arcuate slot, a latch cam having an offset pin at least partially engaged in at least one of the arcuate slot or convex extension slot, a blade having a hole configured to receive the latch cam, and a spring mechanically coupled to the offset pin and configured to exert a force on the offset pin in a direction of blade opening In another aspect, the disclosure includes a folding knife including a latch cam having an offset pin, a reference piece having an arcuate slot and a convex extension slot, and configured to position the offset pin in the convex extension slot when the knife is in a closed position, and further configured to position the offset pin in the arcuate slot when the knife is fully open. Additionally, the folding knife includes a blade configured to rotate about a pivot axis, and having a hole configured to receive the latch cam. The latch cam rotates in a direction that is opposite to a direction of blade rotation when the blade is open less than a predetermined angle.

In still another aspect, the disclosure includes a method of positioning a blade of a folding knife. The method includes receiving at a closed knife an external force configured to open the blade, moving a position of an offset cam pin from within a convex extension to substantially within an arcuate slot, and applying an opening force configured to open the blade to a fully open position without additional external force.

BRIEF DESCRIPTION OF THE DRAWINGS

The features, objects, and advantages of embodiments of the disclosure will become more apparent from the detailed description set forth below when taken in conjunction with the drawings, in which like elements bear like reference numerals.

DETAILED DESCRIPTION OF THE DISCLOSURE

Figure 1A:
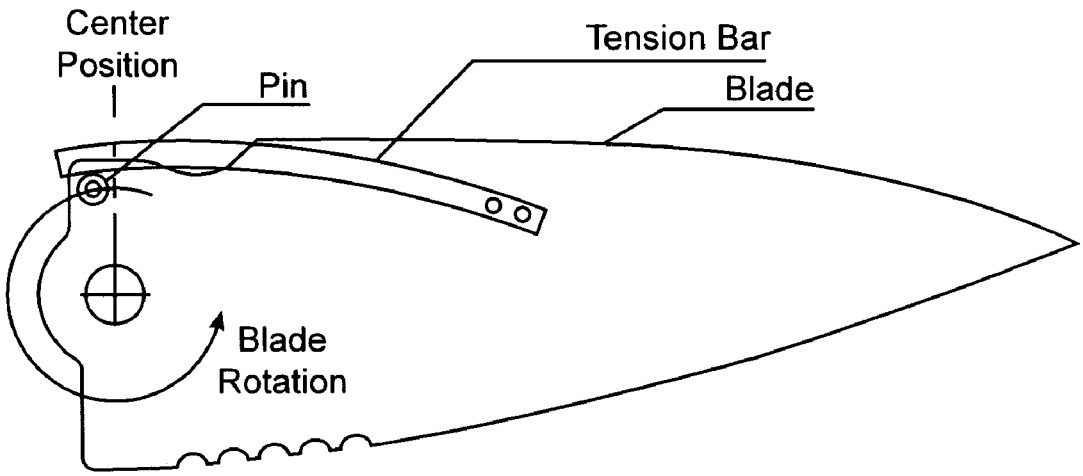
FIG. 1A (PRIOR ART)
FIGS. 1A-1B are views of a prior art blade and tension bar arrangement for a folding knife blade.
Figure 1B:
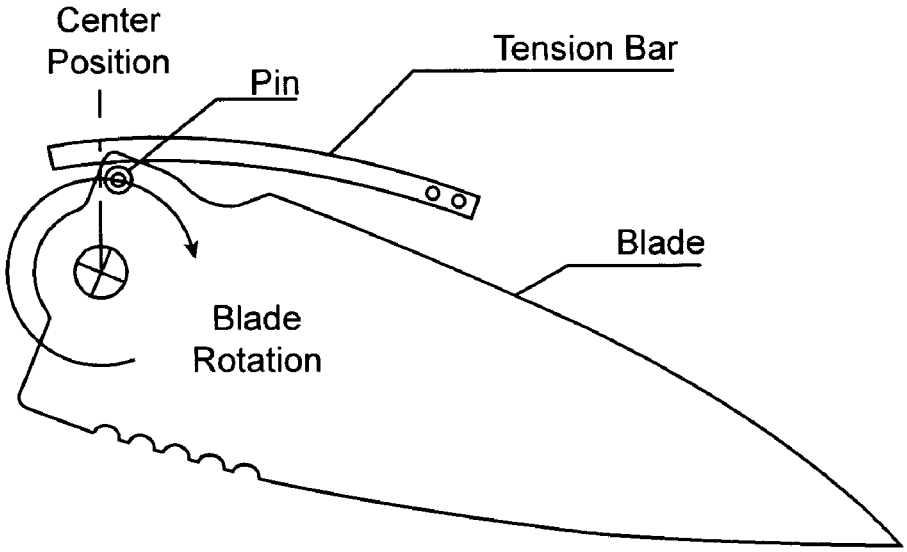
FIG. 1B (PRIOR ART)
Figure 2A:
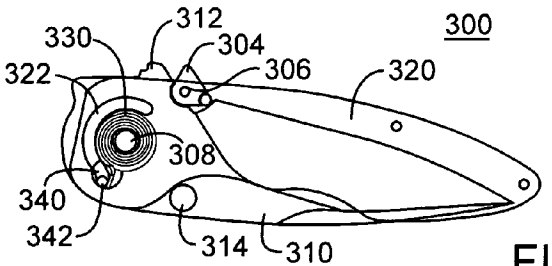
FIGS. 2A-2G are views of a number of positions of a folding knife configuration using a torsion spring of the present disclosure.

FIGS. 2A-2G are cut away views of a number of positions of a folding knife configuration using a torsion spring. FIG. 2A shows a cut away view of a folding knife 300 in the close position. The folding knife 300 includes a blade 310 and liner 320. The blade 310 and liner 320 are typically housed within a handle, which is not shown for clarity.

The knife 300 can include a safety latch 304 that is positioned to secure the blade 310 in the closed position. The safety latch 304 can include a detent 306 that helps to position the latch 304 in the closed or safety position.

The blade 310 includes a stud 314 or protrusion that can be used by a user of the knife 300 to assist in opening the knife 300 or otherwise removing the blade 310 from a closed position where it is shielded by the handle. Typically, the stud 314 is positioned on the blade 310 to facilitate the use of a user's thumb to open the knife 300. The blade 310 can also include a flipper 312 that protrudes from the blade 310. The flipper 312 is typically positioned on the blade 310 on a side of the blade 310 that is opposite the side having the stud 314. The flipper 312 can provide an alternate means for opening the knife 300. Additionally, external force to open the knife 300 can be applied to a combination of the flipper 312 and the stud 314, either serially, simultaneously or some combination of serial and simultaneous operation.

The blade 310 can also include a recess or hole through which a pivot pin 308 passes. The pivot pin 308 can be used to mechanically couple the blade 310 to the handle. The pivot pin 308 typically defines the axis about which the blade 310 rotates.

The blade 310 can include a second recess or hole that is offset from the hole for the pivot pin 308. The second hole can be used to locate a latch cam 340. The latch cam 340 can include at least one pin 342 extending from the latch cam 340. The pin 342 can be located with a center that is offset from the center of the latch cam 340. Thus, as the latch cam 340 rotates within the blade 310, the pin 342 traverses a circle having a radius that is substantially equal to the offset.

A spring 330, such as a torsional spring, can be positioned around the pivot pin 308 to apply a force on the pin 342. A torsional spring 330 can be configured to apply a force on the pin 342 throughout the entire range of motion of the blade 310. Thus, regardless of the position of the blade 310, the torsional spring 330 applies a force on the pin 342 of the latch cam 340 in the direction that the blade 310 takes when opening.

A reference piece can include an arcuate groove or slot 322 that allows for the blade 310 to traverse at least the desired range of rotation. The blade rotates relative to the reference piece.

Figure 2B:
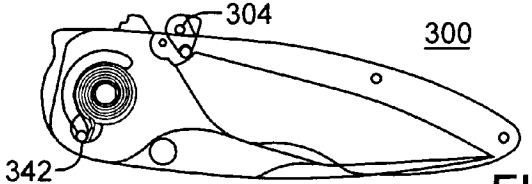
Figure 2C:
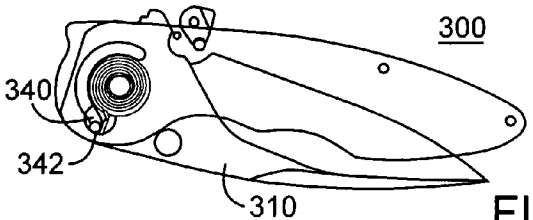
Figure 2D:
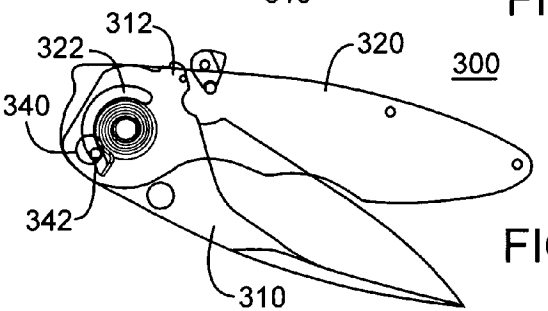
Figure 2E:
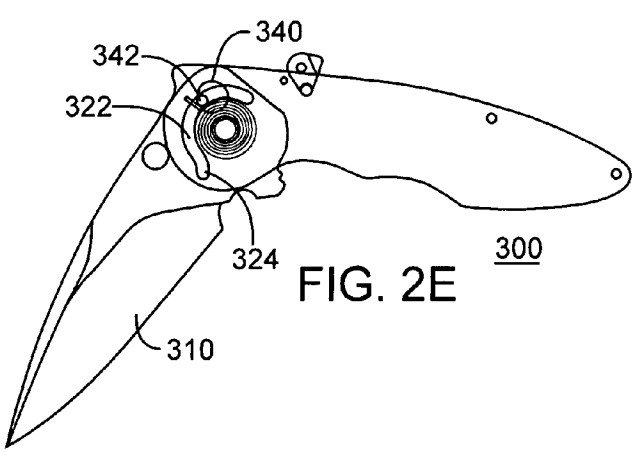
Figure 2F:
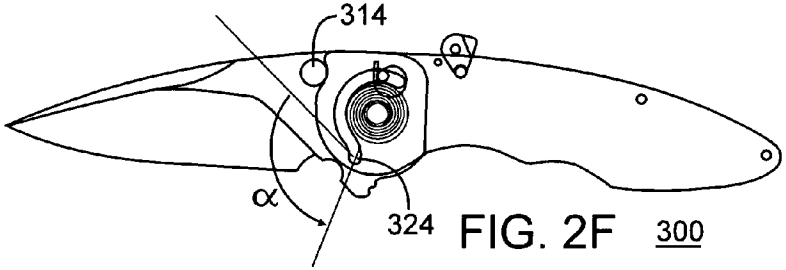

In the embodiment shown in FIGS. 2A-2G, the liner 320 is the reference piece. The liner 320 includes an arcuate groove or slot 322 that allows for the blade 310 to traverse at least the desired range of rotation. If the blade 310 is configured to travel over a range of 180 degrees of rotation, the arcuate slot 322 in the liner 320 is configured to allow the blade 310 to travel at least the desired range of rotation. Thus, although the arcuate slot 322 in the liner 320 can be used to limit the blade's range of rotation, typically, there is some other type of mechanical stop separate from the arcuate slot 322 that is used to limit the blade rotation. The liner 320 also includes a convex extension slot 324 that is positioned on one end of the arcuate slot 322. The extension is convex relative to the shape of the arcuate slot 322. Thus, an angle $\alpha$, as shown in FIG. 2F from a line tangent to the arcuate slot 322 at the connection to the convex extension 324 to a centerline of the convex extension measures less than 180 degrees, and preferably less than 135, 125, 115, 105 degrees. It may also be advantageous for the angle to be greater than 90 degrees.

The pin 342 on the latch cam 340 extends through the arcuate slot 322 or the convex extension 324 depending on the position of the blade 310. As illustrated in FIGS. 2B-2F, the position of the blade 310 and thus the position of the pin 342 within the arcuate groove 322 or convex extension 324 can determine whether the torsional spring 330 provides a force assisting the opening of the blade 310.

In FIG. 2A, the safety latch 304 is shown in the lowered or safety position, thereby preventing the blade 310 from extending to an open position. In FIG. 2B, the safety latch 304 is positioned to allow the blade 310 to open. The torsional spring 330 exerts a force on the pin 342 in the direction of rotation to open the blade 310. However, the pin 342 is positioned within the convex extension 324 to the arcuate groove 322. Thus, the torsional spring 330 applies a force that biases the pin 342 of the latch cam 340 against a wall of the convex extension 324. Thus, the torsional spring 330 does not yet provide a force to rotate the blade 310 to an open position.

FIG. 2C shows the knife 300 with the blade 310 partially open, or partially rotated in the open direction. The blade 310 may rotate open, in response to, for example, a user exerting an opening force on the stud 314 or flipper 312.

As the blade 310 rotates in the opening direction, the latch cam 340 initially rotates in an opposite direction. Thus, if the blade 310 is rotated clockwise, as shown in FIGS. 2A-2G from a closed position to an open position, the latch cam 340 initially rotates in a counterclockwise direction. As the latch cam 340 rotates in the direction opposite the rotation of the blade 310, the pin 342 on the latch cam 340 rotates away from the end of the convex extension 324 and towards the arcuate slot 322.

In FIG. 2D, the blade 310 is opened to a predetermined angle such that the pin 342 of the latch cam 340 is substantially within a portion of the arcuate slot 322. At this predetermined blade angle, the walls of the convex extension 324 no longer provide resistance to the force applied by the torsional spring 330. At this point, the torsional spring 330 applies a force that rotates the blade 310 to the open position.

The flipper 312 can be configured such that when the flipper 312 is flush with the handle of the knife 300, the pin 342 is substantially within the arcuate groove 322 and the rotational force of the torsional spring 330 is no longer impeded by the walls of the convex extension 324. Alternatively, the flipper 312 can be configured such that the pin 342 is substantially within the arcuate groove 322 and the rotational force of the torsional spring 330 is no longer impeded by the walls of the convex extension 324 before the edge of the flipper 312 is flush with the handles of the knife 300. In the embodiment where the rotational force of the torsional spring 330 is no longer impeded by the walls of the convex extension 324 before the edge of the flipper 312 is flush with the handles of the knife 300, the user can ensure spring 330 assisted opening of the blade 310 by pressing the flipper flush with the handles of the knife 300. In still other embodiments, the flipper 312 can be configured such that the pin 342 is substantially within the arcuate groove 322 and the rotational force of the torsional spring 330 is no longer impeded by the walls of the convex extension 324 after the edge of the flipper 312 is below the outline of the handles of the knife 300. In the embodiment where the rotational force of the torsional spring 330 is no longer impeded by the walls of the convex extension 324 after the edge of the flipper 312 is below the outline of the handles of the knife 300, additional external force may need to be applied to the blade 310 before the spring 330 can apply sufficient force to open the blade to the fully open position.

FIG. 2E shows the position of the blade 310 as the torsional spring 330 exerts an opening force on the blade 310. The torsional spring 330 can continue to exert the opening rotational force on the blade 310 until a mechanical limit is reached, such as when the blade 310 has reached a fully open position.

FIG. 2F shows the knife 300 with the blade 310 at the full open position. The torsional spring 330 continues to exert a rotational force on the blade 310. However, a mechanical limit has been reached. Although the pin 342 on the latch cam 340 has not yet reached the end of the arcuate groove 322, the stud 314 positioned on the blade 310 reaches a mechanical stop where it abuts the liner 320 or the handles (not shown). Thus, the mechanical stop on the liner 320 limits the blade 310 from further rotation. Additionally, the liner 320 may include a lock that limits further travel of the blade 310 and secures the blade 310 in the open position.

Figure 2G:
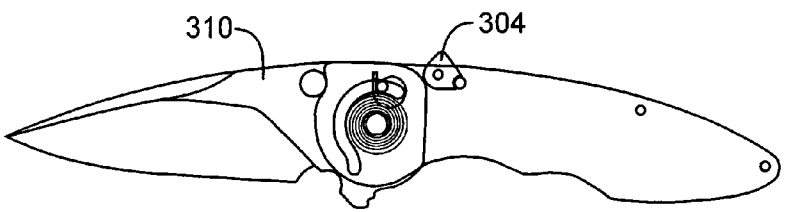

As shown in FIG. 2G, the safety latch 304 can be positioned in the safety position to minimize any protrusions from the knife 300. The safety latch 304 does not need to secure the blade 310 in the open position, because the liner 320 can be configured to perform the blade 310 locking function.

Figure 3A:
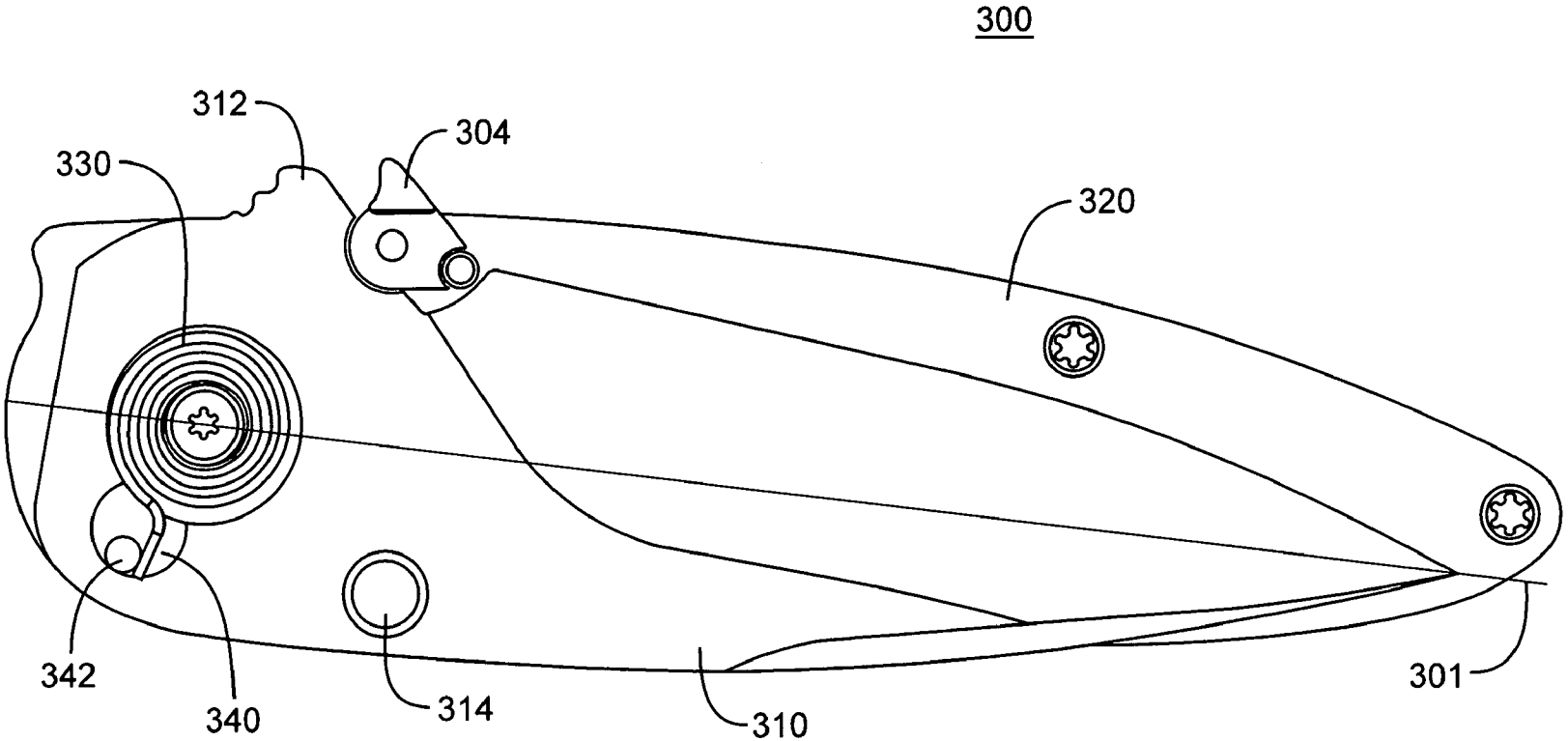
FIGS. 3A-3D are views of a number of positions of a folding knife configuration using a torsion spring of the present disclosure.

FIGS. 3A-3D show views of an embodiment of a folding knife 300. Only portions of the knife 300 are shown for purposes of clarity. FIG. 3A shows a folding knife 300 having substantially the same features as the embodiment shown in FIGS. 2A-2G. The knife includes a blade 310 having a hole or recess for receiving a latch cam 340. The knife 300 also includes the latch cam 340 within the hole in the blade 310. The latch cam 340 includes a pin 342 that is offset relative to an axis of rotation of the latch cam 340. A flipper 312 is positioned on the blade 310 substantially on the same side of the blade 310 as the sharpened edge. A safety latch 304 is shown in the safety or locked position. The knife also includes a liner 320. FIG. 3A shows the folding knife 300 with the blade 310 in the closed position. A reference line 301 is shown in the figure and is defined as the line extending from the blade rotation axis through the tip of the blade 310 when the blade 310 is in the closed position. The reference line 301 will be used to discuss the angular rotation of the blade 310 in FIGS. 3B-3D.

When the blade 310 is in the closed position, the pin 342 of the latch cam 340 is positioned substantially within the convex extension (not shown in this view). The spring 330 exerts a force on the pin 342 of the latch cam 340 in the direction that opens the blade 310. However, as discussed in FIG. 2B, the wall of the convex extension (not shown in this figure) impedes the rotation of the blade 310.

Figure 3B:
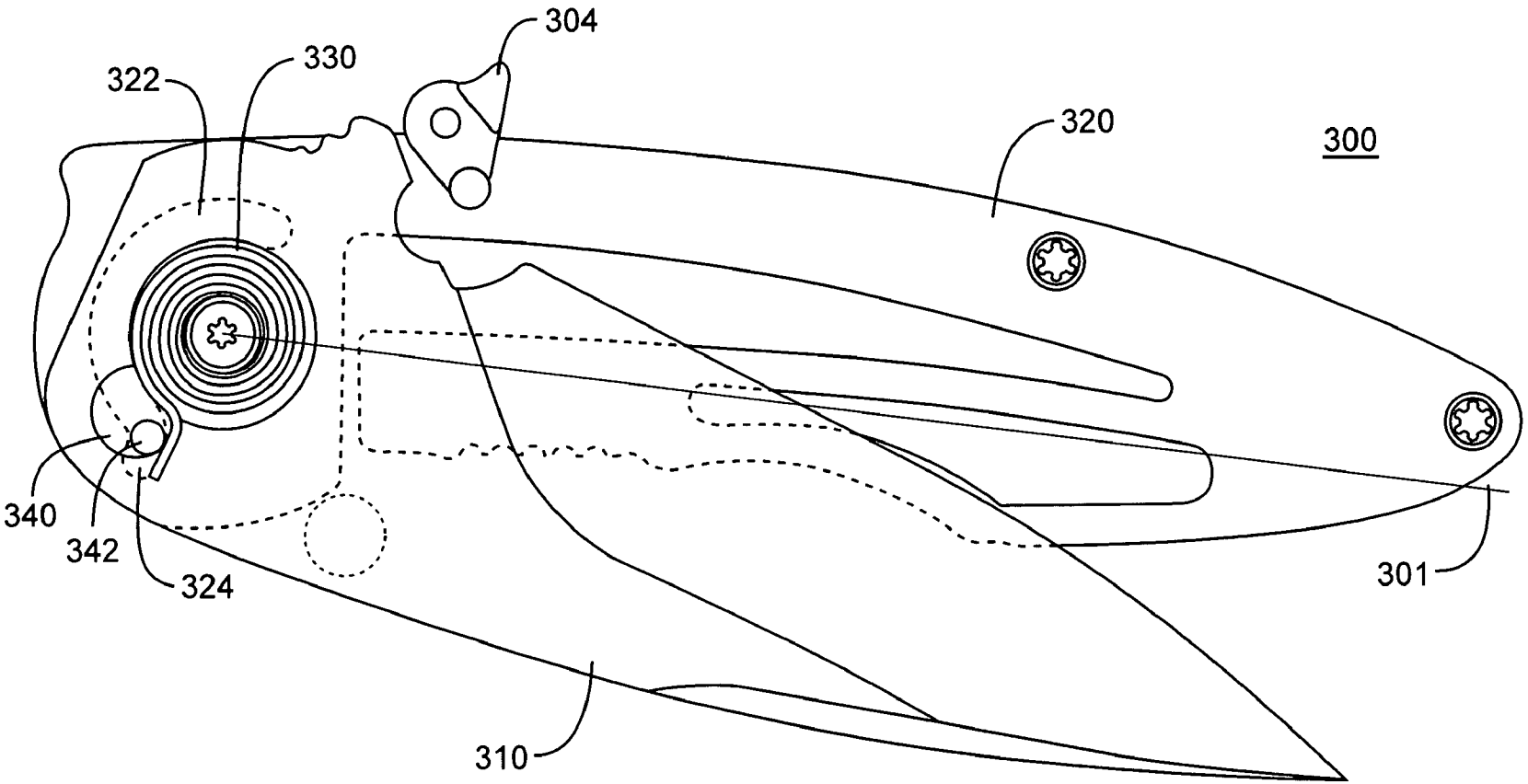

FIG. 3B shows a view of the knife 300 with the blade 310 partially open. The blade 310 has rotated clockwise relative to the reference line 301. The line extending from the blade axis of rotation through the tip of the blade 310 defines an angle with the reference line 301. Rotating the blade 310 moves the position of the pin 342 on the latch cam 340. At a predetermined angle shown in FIG. 3B, the pin 342 on the latch cam 340 has repositioned to a position on the convex extension 324 that meets the arcuate slot 322. When the blade 310 rotates less than the predetermined angle, the walls of the convex extension 324 impede the force that the spring 330 exerts against the pin 342. When the blade 310 rotates greater than the predetermined angle, the walls of the convex extension 324 no longer impede the force that the spring 330 exerts against the pin 342. Thus, when the blade 310 is rotated greater than the predetermined angle, the pin 342 is no longer positioned substantially within the convex extension 324. Instead, the pin 342 is positioned substantially within the arcuate slot 322.

Figure 3C:
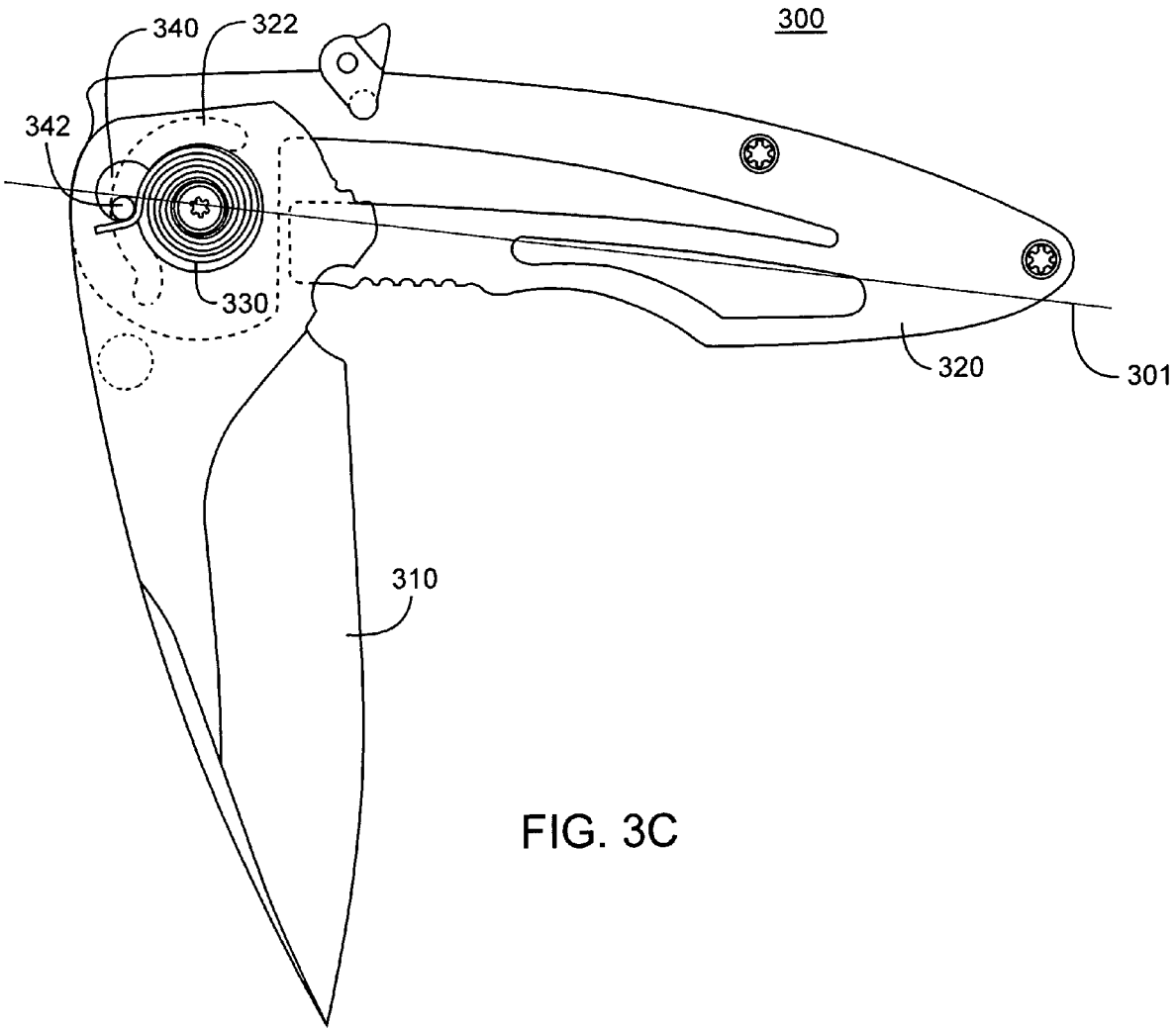

FIG. 3C shows another view of the knife 300 with the blade 310 partially open. However, in the view of FIG. 3C, the angle of the blade 310 is greater than the predetermined angle. The pin 342 is substantially within the arcuate slot 322. The force the spring 330 exerts on the pin 342 of the latch cam 340 is substantially unimpeded. Thus, the spring 330 exerts a force in the direction that opens the blade 310. If the spring 330 can exert sufficient force, the spring 330 can drive the blade to a fully open position without any additional external force. That is, the spring 330 can continue to rotate the blade 310 until the blade 310 reaches a mechanical stop. The blade 310 may also stop rotating if the force applied by the spring 330 is insufficient to maintain blade rotation.

Figure 3D:
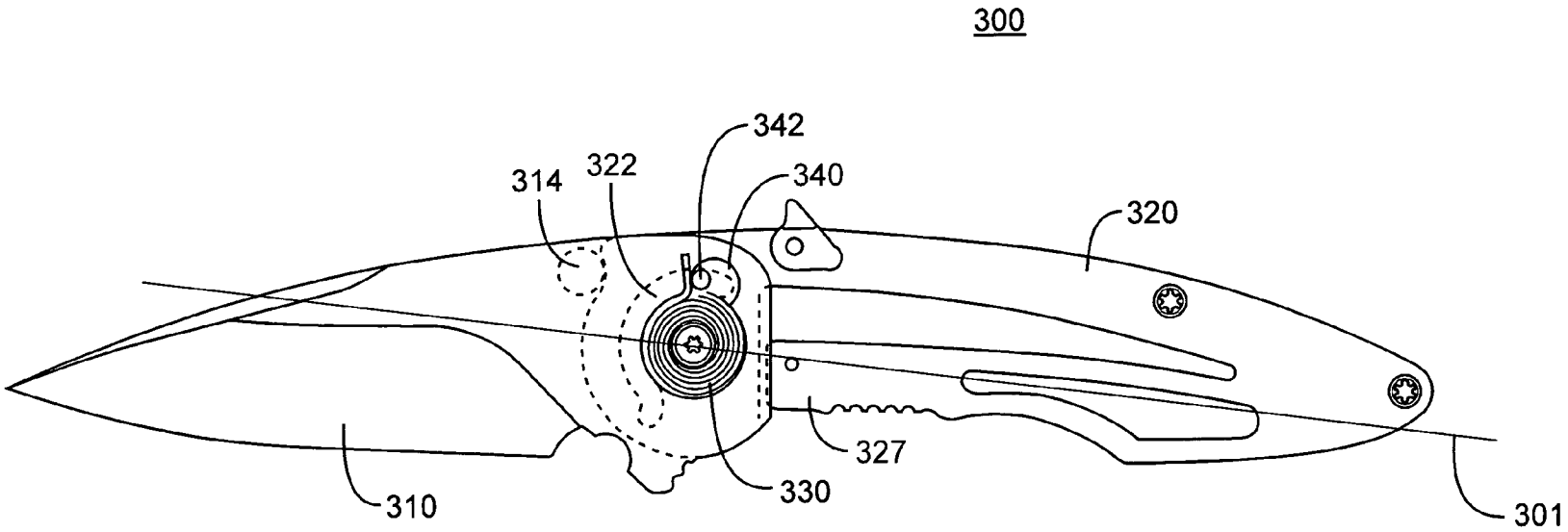

FIG. 3D shows a view of the knife 300 with the blade in substantially the fully open position. The spring 330 continues to exert a rotational force on the pin 342, and the blade 310. The pin 342 has not yet reached the end of the arcuate slot 322. However, a mechanical stop prevents the blade 310 from further rotation. In the embodiment shown in FIG. 3D, the stud 314 abuts a portion of the liner 320 thereby preventing further rotation. Additionally, a lock portion 327 of the liner 320 may spring into a plane of the blade 310 and secure the position of the blade 310. The lock portion 327 of the liner 320 can be repositioned off of the plane of the blade 310 to release the blade 310 from the lock.

Figure 4A:
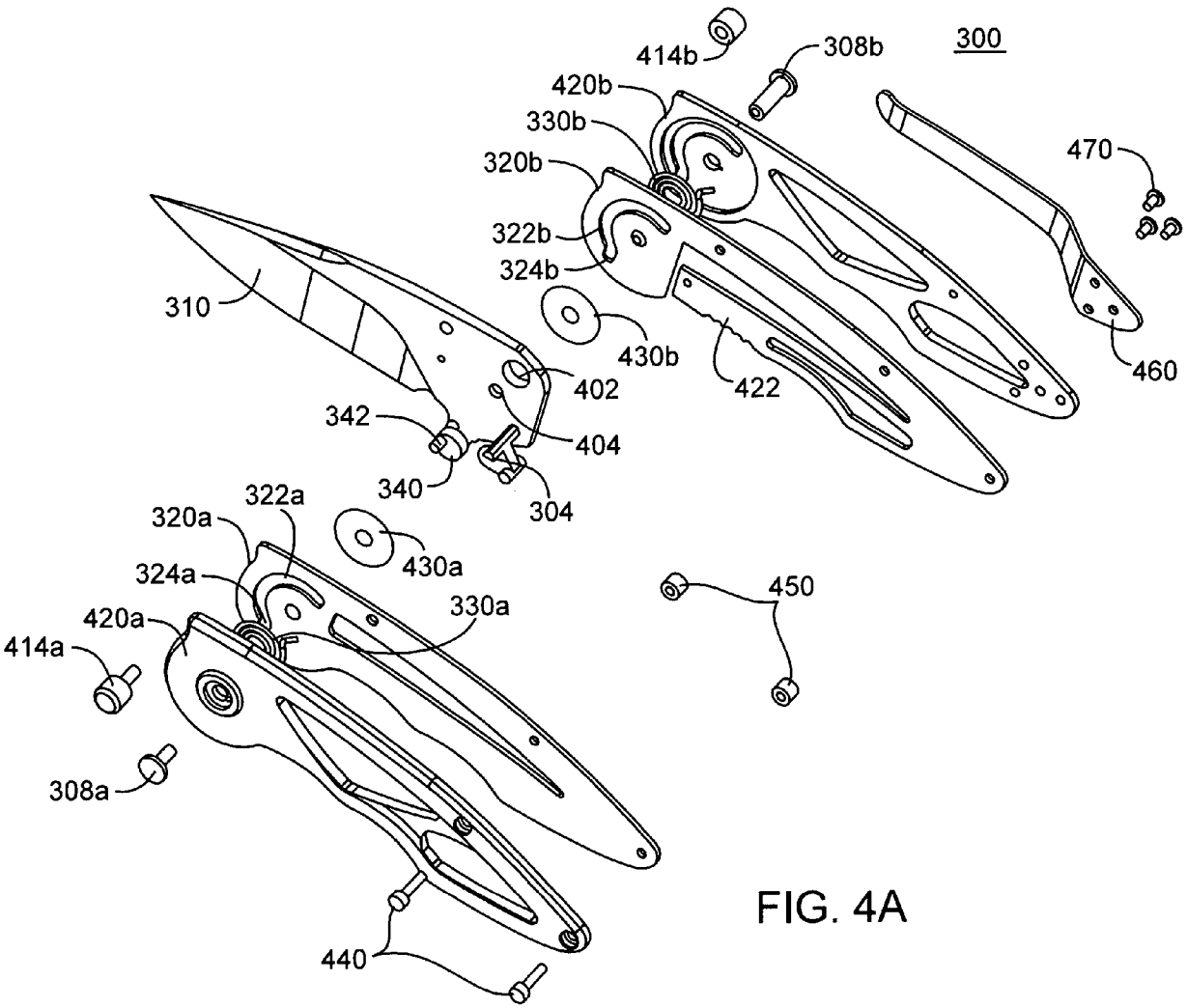
FIG. 4A is an exploded view of a folding knife having a spring assist of the present disclosure.

FIG. 4A is an exploded view of an embodiment of the knife 300. As can be seen from the figure, many of the functions of the knife 300 can be duplicated in left and right hand sides, although such duplication is not a limitation. In the description, the terms left hand and right hand refer to the left and right hand sides of the blade when viewed from a top view, where the top is the side opposite the opening that receives the sharpened edge of the blade 310. The duplication of functions in the left and right hand sides of the knife 300 can advantageously balance the forces applied to the blade 310, thus minimizing the amount of side force exerted on the blade 310. The left and right hand parts may be mirror images of each other or may include distinct features not found in the other half.

The exploded view of an embodiment of the knife 300 generally shows the relationship of the various parts. The knife 300 includes a blade 310 housed within left and right handles 420*a* and 420*b*, respectively. The blade 310 includes a first hole 404 configured to receive the pivot pin. The pivot pin comprises halves 308*a* and 308*b*. The blade 310 rotates about an axis extending through the first hole 404. The axis of blade rotation is typically the centerline of the pivot pin. The blade 310 can also be configured to receive a thumb stud comprising left and right hand studs, 414*a* and 414*b*, respectively.

The blade 310 also includes a second hole 402 configured to receive the latch cam 340. The second hole 402 in the blade 310 can be sized to allow the latch cam 340 to rotate freely within the hole. The latch cam 340 includes at least one pin 342. In the embodiment shown in FIG. 4A, the latch cam 342 includes two pins that extend outwardly in a direction substantially perpendicular to the plane in which the blade 310 rotates. Typically the two pins are axially aligned. The knife 300 can include a safety latch 304.

The knife 300 also includes left and right washers 430*a* and 430*b*, respectively, that can function as bushings, bearings, or spacers. The left and right washers 430*a* and 430*b* can facilitate the blades rotation.

Left and right hand liners 320*a* and 320*b* are positioned on the left and right hand sides of the blade 310. In the embodiment shown in FIG. 4A, the left hand liner includes an arcuate slot 322*a* having a convex extension 324*a* at one end of the arcuate slot 322*a* Similarly, the right hand liner 320*b* includes an arcuate slot 322*b* having a convex extension 324*b* positioned at one end of the arcuate slot 322*b*. Additionally, the right hand liner 320*b* includes a liner lock 422, which can be a spring portion of the liner 320*b* that secures the blade 310 in the open position when the blade 310 is completely open.

The knife 300 also includes, on each side of the blade 310, torsional springs 330*a* and 330*b* positioned about the pivot pin and configured to provide a force against the pin of the latch cam 340 in the direction of blade opening.

The left torsional spring 330*a* can have one end located within a receiving hole (not shown) in the left handle 420*a*. The other end of the left torsional spring 330*a* can be configured to mechanically couple to the left hand pin of the latch cam 340. Thus, the left hand torsional spring 330*a* applies a force against the left pin of the latch cam 340 in a direction to drive the blade 310 to a fully open position. The torsional springs 330*a* and 330*b* thus indirectly apply a force to the blade 310 via the latch cam 340.

The right hand torsional spring 330*b* can similarly have one end located in a receiving hole (not shown) in the right hand handle 420*b*. The opposite end of the right hand torsional spring 330*b* can be configured to mechanically couple to the right hand pin of the latch cam 340. The right hand torsional spring 330*b* can also apply a rotational force to the blade 310 to drive the blade 310 to a fully open position.

The left and right hand handles 420*a* and 420*b* retain the parts of the knife 300 using a variety of hardware, including screws 440 and spacers 450. One side of the knife 300 also includes a belt clip 460 fastened to the right hand handle 420*b* by a number of rivets or screws 470. Although the knife 300 is shown assembled using screws, any number of fasteners and fastening means may be used to attach the various pieces together. For example, screws, rivets, nails, brads, staples, bolts springs or clasps may be used to join two or more of the pieces. Additionally, interference fit, glue, epoxy, adhesive, welds, braze, solder can be used to join together two or more of the pieces of the knife 300.

Figure 4C:
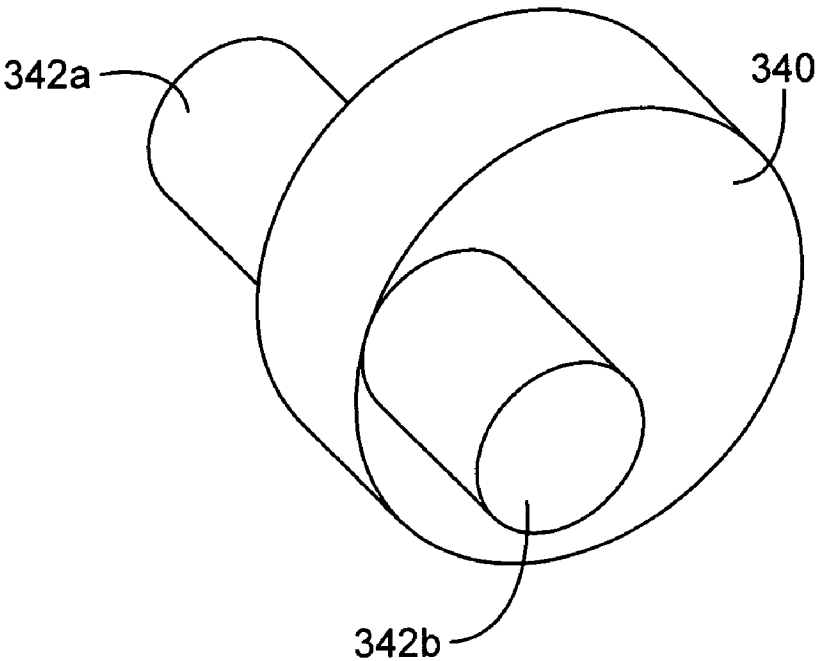
FIGS. 4B-4C are detailed view of the torsional spring and the latch cam of the present disclosure.
Figure 4B:
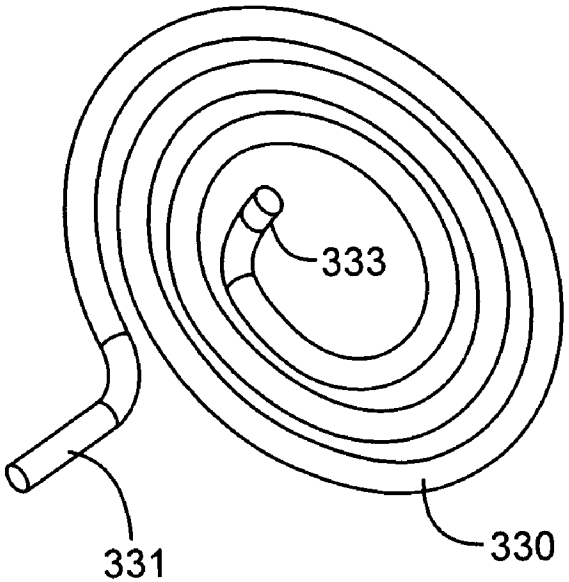

FIG. 4B is a perspective view of an embodiment of the torsional spring 330 that may be used in the knife embodiments shown in FIGS. 2-5. The spring 330 includes a first end 331 and a second end 333. The first end 331 can be configured to mechanically couple the spring 330 to the pin of the latch cam. The first end 331 of the spring 330 can be positioned outward from the coils of the spring 330. The first end 331 of the spring 330 can be configured to be in substantially the same plane defined by the coils of the spring 330.

The second end 333 of the spring 330 can be configured to mechanically couple to a stop, pin, recess, hole, and the like, or some other means for locating an end of the spring 330. The second end 333 of the spring 330 can be configured to extend away from the plane defined by the coils of the spring 330. The spring embodiment shown in FIG. 4B includes a second end 333 that extends substantially perpendicular to the plane defined by the coils of the spring 330. The spring 330 embodiment of FIG. 4B can be manufactured from round stock. Alternatively, the spring 330 can be manufactured from flat stock, rectangular stock, and the like, or some other suitable spring material. Additionally, the spring 330 does not need to be manufactured in substantially a single plane.

FIG. 4C is a perspective view of an embodiment of a latch cam 340 having a first pin 342*a* and a second pin 342*b*. The first pin 342*a* and second pin 342*b* are configured to have the same central axis. The central axis of the pins 342*a* and 342*b* are offset from a rotational axis of the latch cam 340. The first pin 342*a* does not need to be positioned opposite the second pin 342*b*. However, such placement can simplify the design and placement of the arcuate slots and convex extensions of corresponding pieces.

Additionally, the pins 342*a* and 342*b* are shown as cylinders. However, the shape of the pins 342*a* and 342*b* are not limited to cylinders, and can be a variety of shapes including, but not limited to, polygonal, ellipsoidal, conical, as well as various other shapes.

FIGS. 5A-5F are detailed views of relationships of a portion of a blade 310, a portion of a liner 320 having an arcuate slot 322 with a convex extension 324 on one end, latch cam 340 having a pin 342, and spring 330. The various parts are shown as functional blocks merely to illustrate the relationship of the parts. The parts of the knife may not actually appear as the functional representations shown in FIGS. 5A-5F.

Figure 5B:
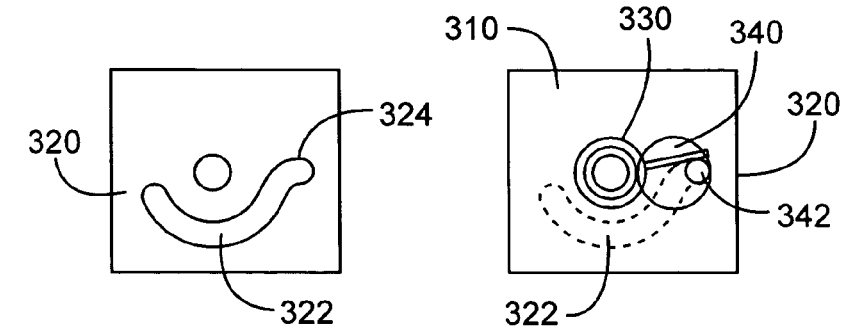
FIGS. 5A-5F are detailed views of relationships of a latch cam, spring, and guide of the present disclosure.
Figure 5C:
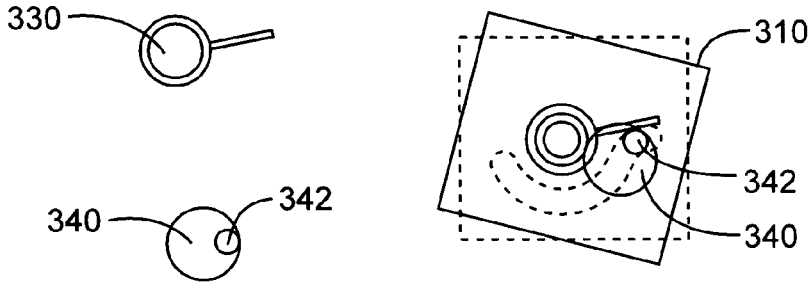
Figure 5A:
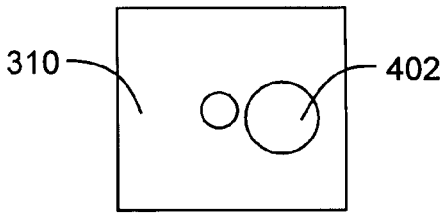

FIG. 5A shows the various functional representations. A liner 320 includes an arcuate slot 322 having positioned on one end a convex extension 324. The arcuate slot 322 and convex extension 324 may extend completely through the liner 320. Alternatively, the arcuate slot 322 and convex extension 324 may be recesses within the liner 320. In other embodiments, all or only a portion of the arcuate slot 322 and convex extension 324 may extend through the liner 320 with the remaining portions recessed within the liner 320.

A torsional spring 330 can be configured around an axis of blade rotation. The torsional spring 330 includes an end that is configured to mechanically couple a spring force to the latch cam 340. The latch cam 340 includes a pin 342 that can be mechanically coupled to the torsional spring 330. Additionally, the pin 342 is received and located within the arcuate slot 322 or convex extension 324 of the liner 320. The pin 342 can be located offset from the rotational axis of the latch cam 340.

A blade 310 includes a hole 402 configured to receive the latch cam 340. The hole 402 is offset from an axis of rotation and is positioned such that the pin 342 of the latch cam 340 can be positioned within the arcuate slot 322 or convex extension 324 when the knife is assembled.

FIG. 5B shows a view of the functional blocks when the blade 310 is in a closed position. The pin 342 of the latch cam 340 is sufficiently positioned within the convex extension 324 such that the force applied by the torsional spring 330 is impeded by the walls of the convex extension 324. Thus, although the torsional spring 330 applies a force in the direction of blade opening, the force is impeded by the walls of the convex extension 324.

FIG. 5C shows a view of the functional blocks with the blade 310 partially opened. The blade 310 can partially open in response to an external force applied by a user. For example, a user can apply a blade opening force via the stud or flipper shown in FIGS. 2A-2G. The pin 342 of the latch cam 340 remains sufficiently positioned within the convex extension 324 such that the force of the torsional spring 330 is still impeded by the walls of the convex extension 324. As the blade 310 rotates clockwise, the latch cam 340 initially rotates counterclockwise relative to its original position within the blade 310.

Figure 5D:
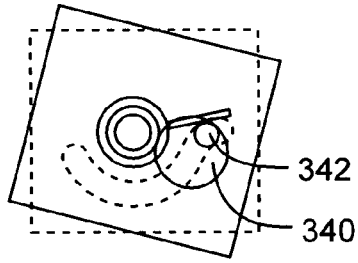

FIG. 5D shows a view of the functional blocks with the blade opened slightly further than that shown in FIG. 5C. At this predetermined position, which may be referred to as a predetermined angular position, the blade 310 has rotated a sufficient amount such that the pin 342 of the latch cam 340 is on the verge of entering the arcuate slot 322. At this predetermined angular position, the force applied by the torsional spring 330 may no longer be sufficiently impeded by the walls of the convex extension 324. Thus, once the blade 310 has rotated, or otherwise opened, past the predetermined angular position, the torsional spring 330 provides an opening force to the blade 310.

Figure 5E:
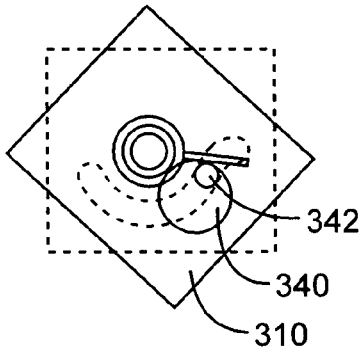

FIG. 5E shows a view of the functional blocks with the blade 310 past the predetermined angular position. The pin 342 of the latch cam 340 is positioned substantially within the arcuate slot 322. The torsional spring 330 exerts an opening force on the pin 342, thereby applying an opening force on the blade 310. Thus, depending on the amount of force applied by the torsional spring 330, the blade 310 may continue to open without any external force applied by a user.

Figure 5F:
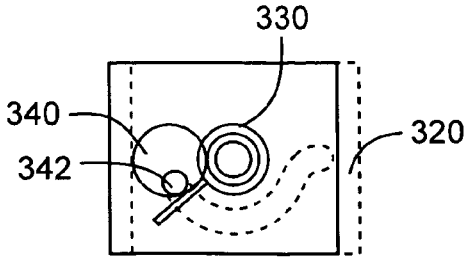

FIG. 5F shows a view of the functional blocks with the blade 310 in substantially the completely open position. In the embodiment shown in FIG. 5F, the pin 342 of the latch cam 340 extends to the end of the arcuate slot 322 in the liner 320. The torsional spring 330 continues to apply a force in the blade opening direction. However, further rotation of the blade 310 is impeded by the end of the arcuate slot 322. Thus the liner 320, through the configuration of the arcuate slot 322, provides a mechanical stop for the blade 310. As shown in previous figures, other embodiments of the knife may use a different mechanical blade stop and may not rely on the configuration of the pin within the arcuate slot 322 for a blade stop.

The knife is closed by reversing the opening operation. However, because the torsional spring 330 can apply an opening force to the blade 310, a user may need to overcome the force applied by the spring in order to close the knife. Once the pin 342 on the latch cam 340 is sufficiently positioned within the convex extension 324, the opening force of the torsional spring 330 is impeded by the configuration of the convex extension 324. Thus, once the user has closed the blade 310 to a position less than the predetermined angular position, the user may not need to overcome the force of the torsional spring 330.

Figure 6:
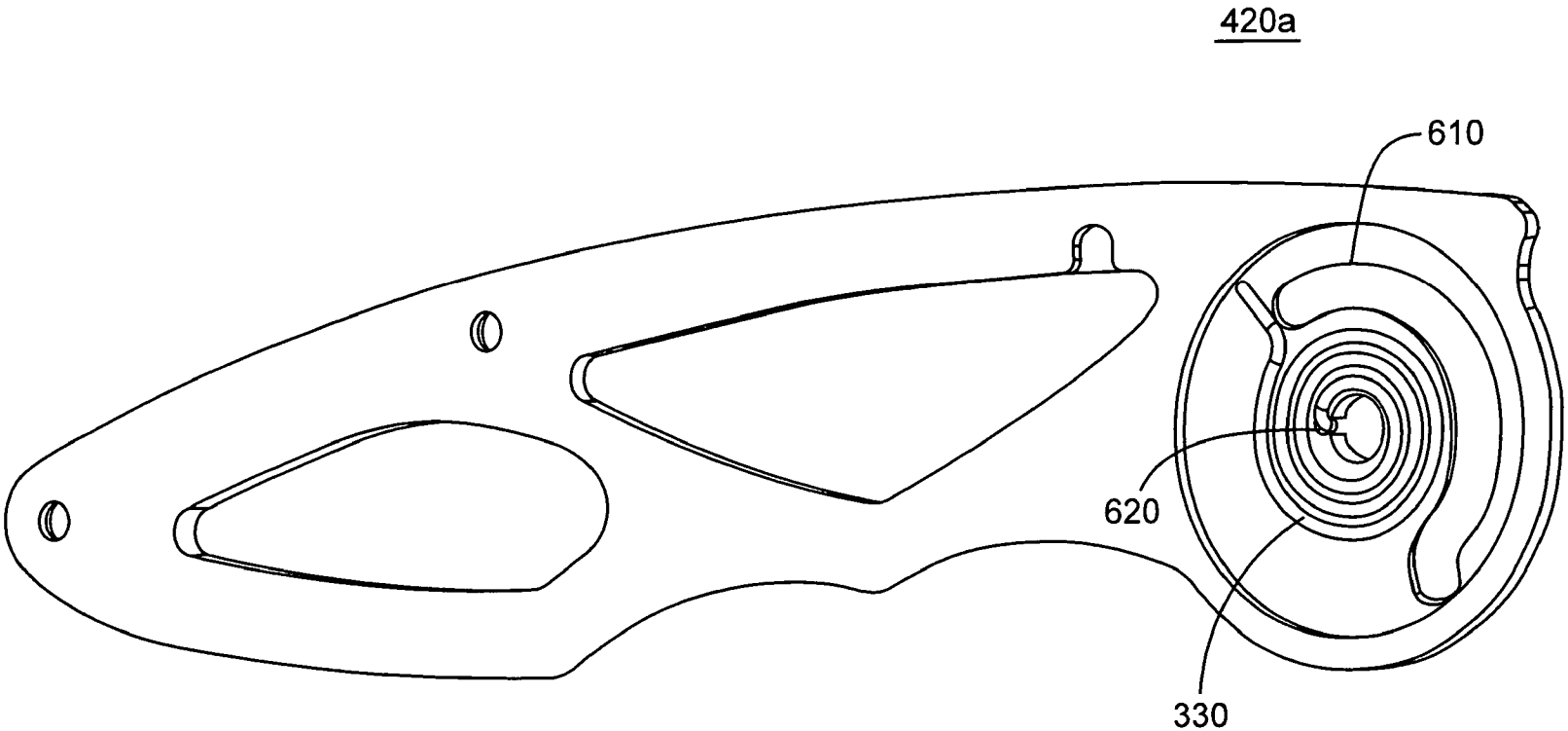
FIG. 6 is a view of an embodiment of a handle of the present disclosure.

FIG. 6 is a perspective view of a left side handle 420*a*. The left hand side handle 420*a* can include a recess 610 that substantially corresponds to the arcuate slot and convex extension of the liner. In one embodiment, the pin of the latch cam can be supported by the recess 610 in the handle 420*a*. The walls of the recess 610 can further contribute to maintaining the blade position when the knife is in the closed position and the pin of the latch cam is positioned within the convex extension.

The handle 420*a* is shown with the torsional spring 330 positioned in a spring receptacle 620 of the handle 420*a*. The receptacle 620 can be a slot or groove which mechanically couples to a portion of the torsional spring 330. In the embodiment shown in FIG. 6, the receptacle includes a notch that is configured to receive an end of the spring 330. The end of the spring 330 is configured such that when the end is coupled to the receptacle, the spring is located to the handle 420*a*. Thus, the end of the spring 330 can be fixed to the handle using the receptacle 620.

Embodiments of the spring assisted knife do not require the arcuate slot and latch cam to be positioned as shown in FIGS. 3-6. Alternative embodiments may have the arcuate slot positioned in the blade and the latch cam positioned in the liner or handle. In general, the arcuate slot can be positioned in a reference piece that rotates relative to the blade. Thus, in the previous embodiments, the reference piece can be one or more liners, one or more handles, or a combination of one or more liners and handles. Additionally, one or more of the parts of the knife may be positioned within intermediate parts not shown in FIGS. 3-6. For example the latch cam or some other part may be positioned in an intermediate element not shown in the prior embodiments. Additionally, although a torsional spring is shown in the various embodiments, an alternative spring may be substituted.

FIGS. 7-13 are of an alternative embodiment where a drive pin can be driven by a torsional spring to assist in opening the knife. In the alternative embodiment, the handle can include the arcuate slot with the convex extension positioned at one end of the slot.

Figure 7:
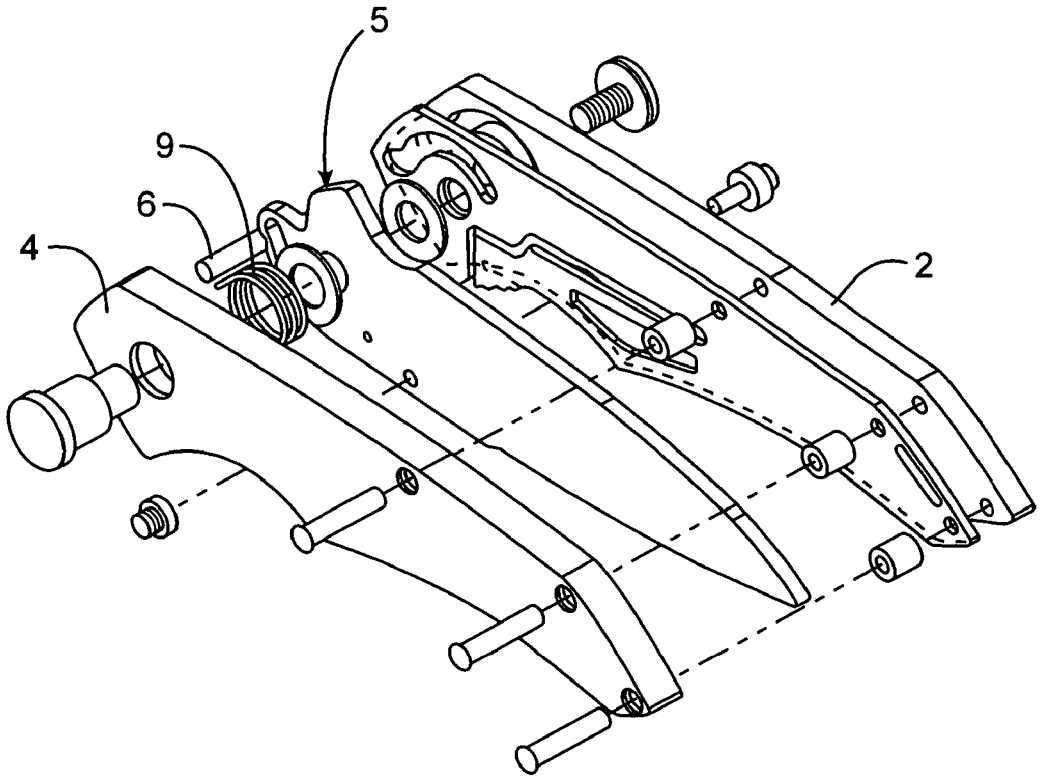
FIGS. 7-13 are view of an alternative folding knife embodiment of the present disclosure.

FIG. 7 is an exploded view of an alternative embodiment of the spring assisted knife. The knife can incorporate a torsion spring 9 to apply a substantially even opening force throughout the range of blade travel. The spring pushes a drive pin 6 through two different tracks, one in the handles, 2 and 4, of the knife, another in the blade 5. The design of the two tracks working in conjunction with the drive pin 6 and the spring 9 allows the blade 5 to remain in the closed position until the knife is intentionally opened. Once blade 5 movement is initiated by the user and the knife is opened beyond a predetermined angular position, the torsion spring 9 takes over and forces the drive pin 6 through its tracks. End of travel results in an opened knife with the blade 5 in the locked position.

Figure 8:
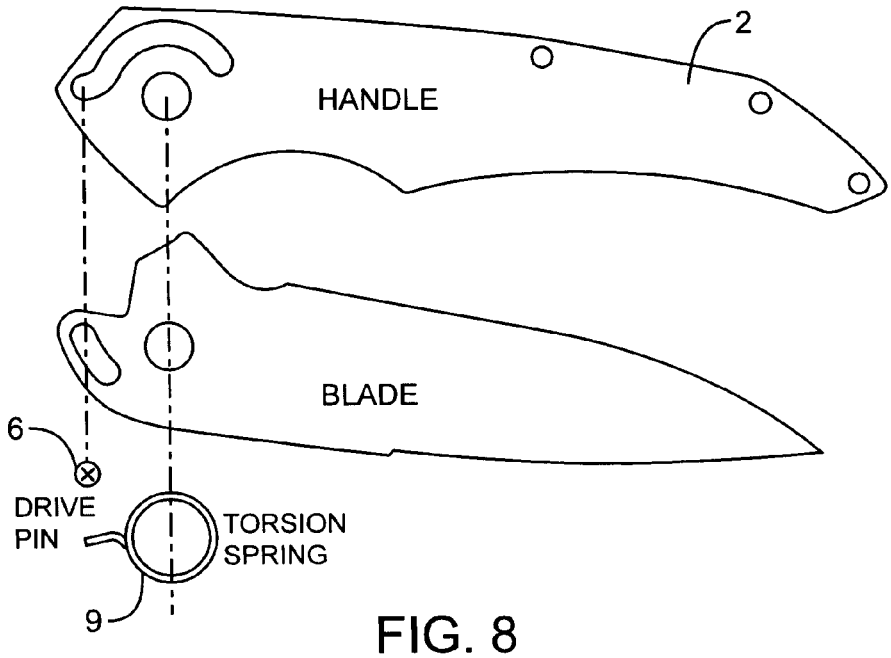
Figure 9:
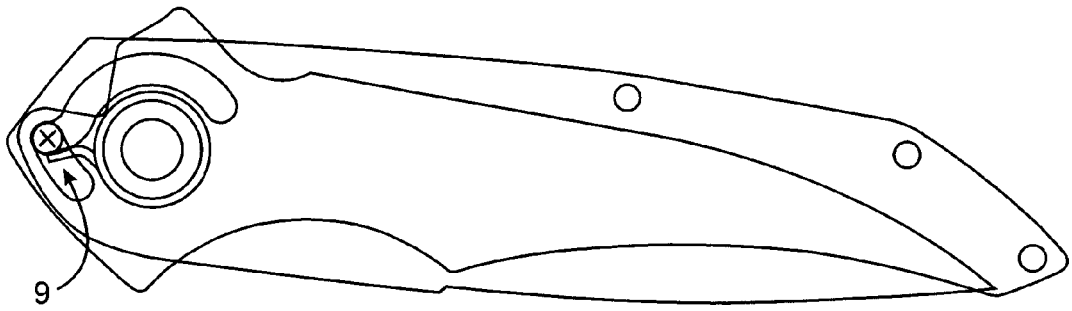

FIGS. 8 through 13 are side views that also depict the alternative embodiment of the spring assisted knife. FIG. 8 identifies the components of the views, while FIGS. 9 through 13 show the knife blade in various angular positions. FIG. 9 shows the side view of the knife with components in place and the blade in the closed position. The torsion spring is at its full potential and is forcing the drive pin into the horizontal section of the track in the handle. This section of track retains the blade in the closed position. The outer radius of the handle track is a portion of the track used by the drive pin.

Figure 10:
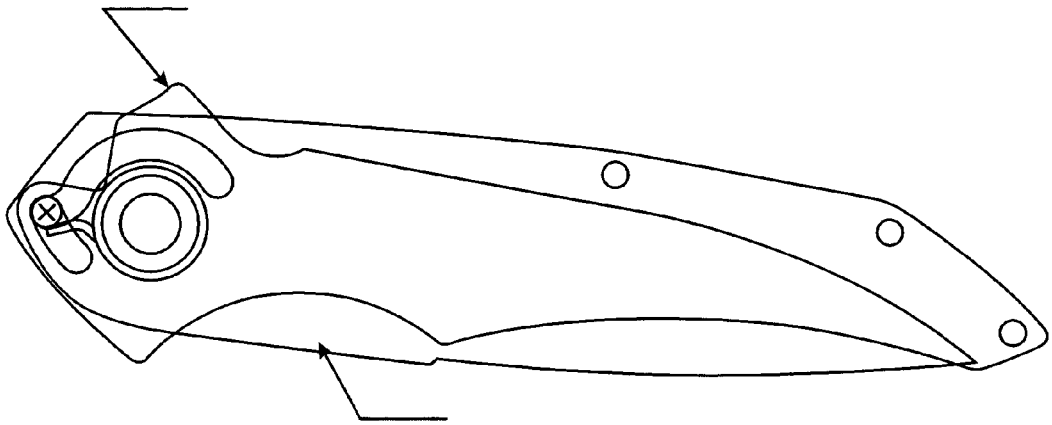
Figure 11:
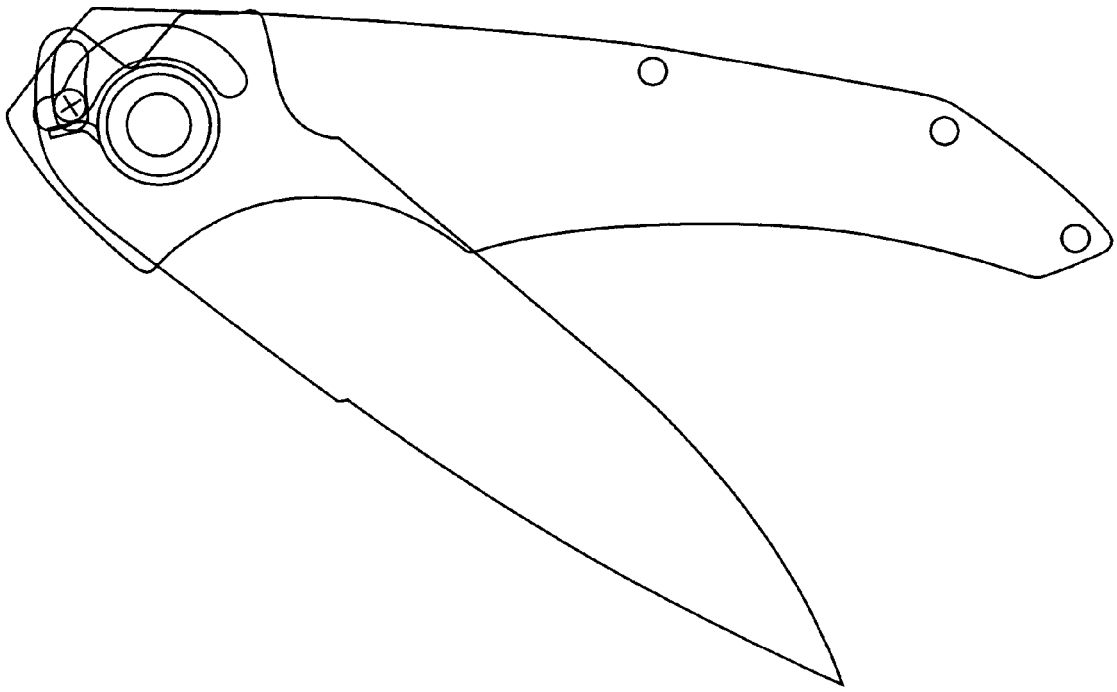
Figure 12:
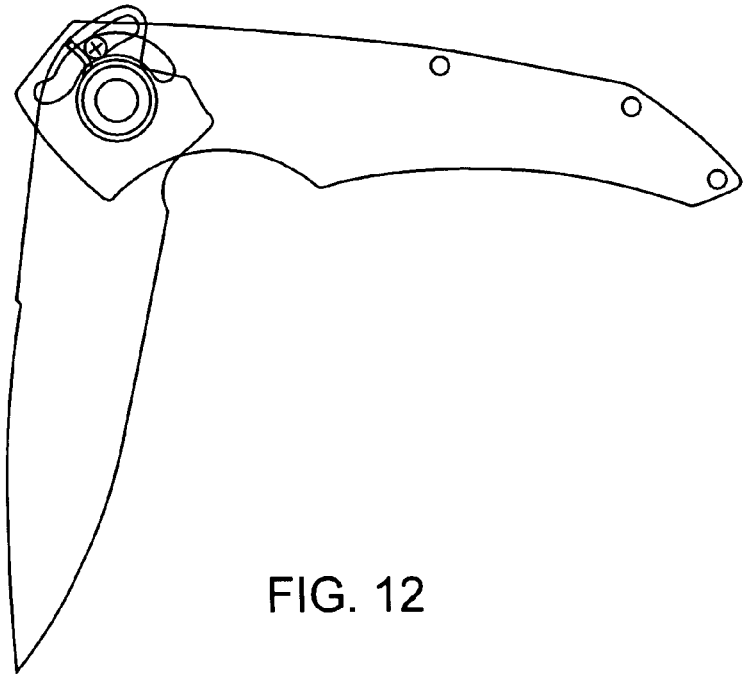
Figure 13:
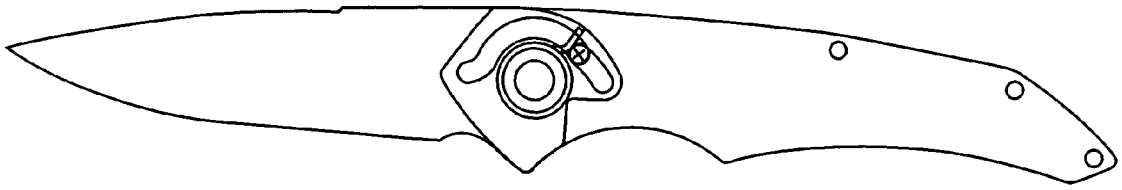

FIG. 10 points out two locations attached to the blade where the user can begin blade movement. FIG. 11 illustrates the drive pin leaving the rest position. The potential of the torsion spring takes over and propels both drive pin and blade through nearly 180° rotation to the locked position. FIG. 12 shows further advancement of the drive pin and blade as the torsion spring moves the pin through the track in the handle. Finally, FIG. 13 shows the drive pin, blade and spring at the end of its travel. The torsion spring is at its minimum potential. The drive pin is at the end of the track within the knife handle and at end of travel within the slot located on the blade. To fully lock the blade into position a liner lock can be used (not shown for clarity).

Figure 14:
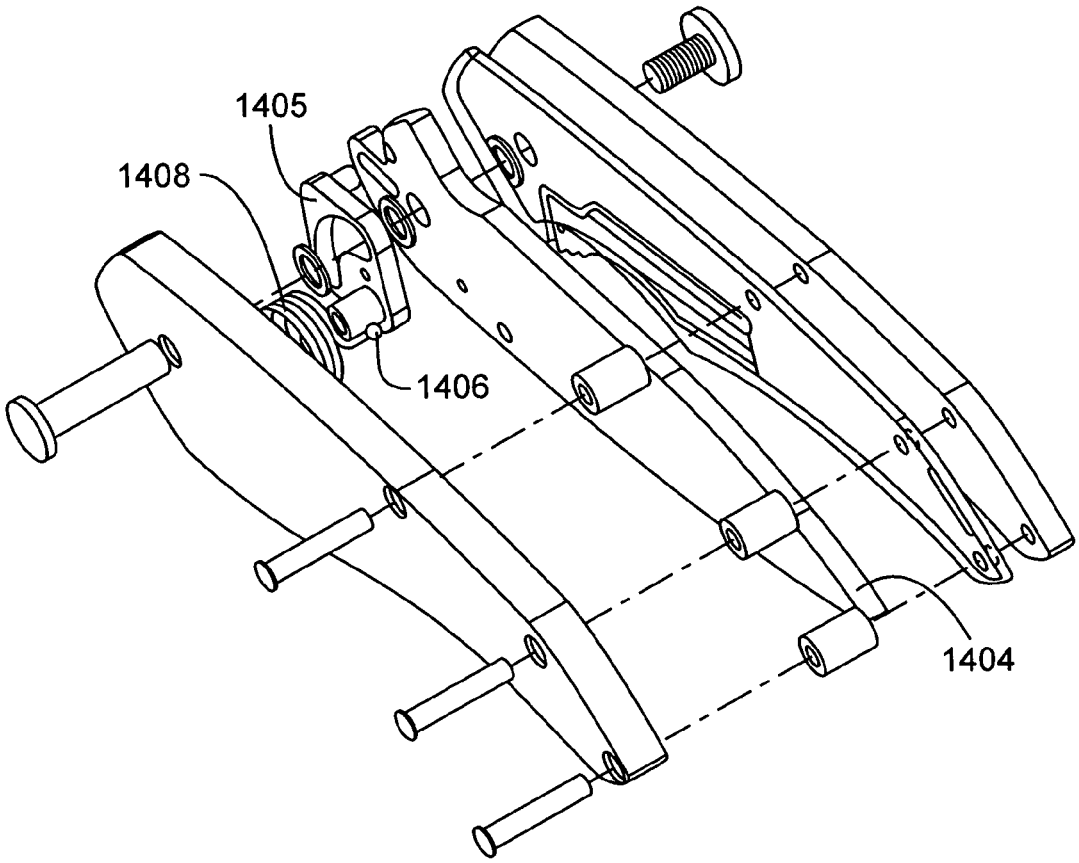
FIGS. 14-20 are view of an alternative folding knife embodiment of the present disclosure.

FIGS. 14-20 show another alternative embodiment of a spring assist knife where the knife blade is driven by a lever or crank called an Angle Doubler (AD). A pin 1406 can be press fit, or otherwise mechanically coupled, to the AD 1405 as shown in FIG. 14. The pin 1406 fits in a slot on the blade 1404. The energy behind the AD 1405 is the torsion spring 1408. The torsion spring 1408 acts on the AD 1405, causing the doubler to rotate a full 90°. The drive pin 1406 on the doubler 1405 rotates the blade 1404 which in turn rotates 180°. Because the torsion spring 1408 is allowed to follow the doubler 1405 through its entire travel, a substantially consistent force can be applied to the blade 1404.

Figure 15:
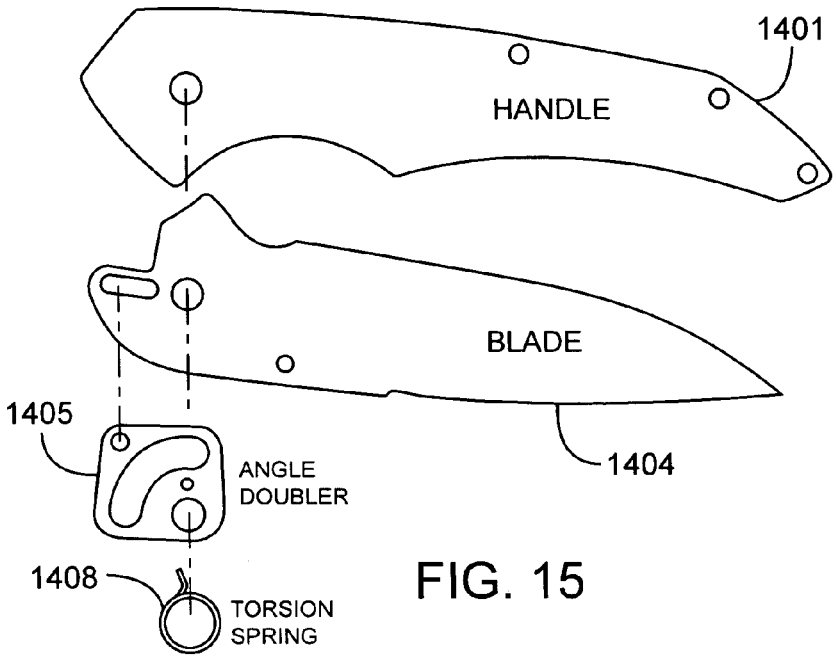

FIGS. 15 through 20 are side views that also depict the AD knife design and its operation. FIG. 15 identifies the components in the remaining views. The handle 1401 mechanically couples to the blade 1404 via an angle doubler 1405. The torsional spring 1408 applies a force on the angle doubler 1405, and thus the blade 1404.

Figure 16:
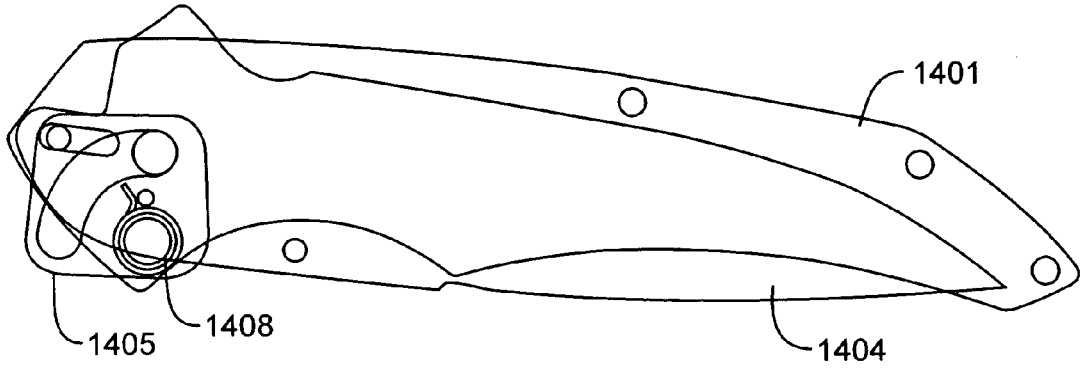

FIGS. 16 through 20 show the knife blade in various positions. FIG. 16 shows the side view of the knife with components in place and the blade 1404 in the closed position. The torsion spring 1408 can be at its full potential when the knife is in the closed position.

Figure 17:
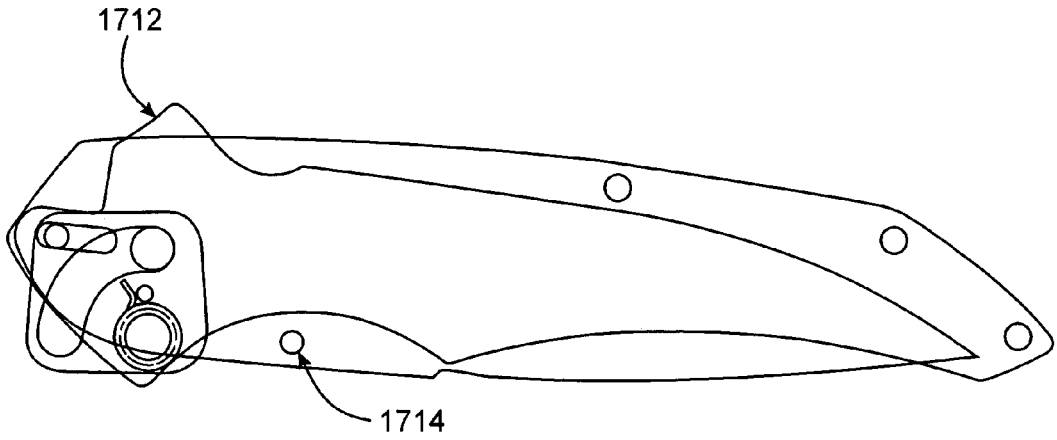

In succeeding views it will be evident that for every degree of angle doubler crank rotation, the blade will rotate greater than that amount, and substantially twice that amount. FIG. 17 points out two locations where the user can begin blade movement. The user can, for example, apply an opening force on the flipper 1712 that is similar to the flipper of FIG. 3. Alternatively, the user can apply an opening force using the thumb stud 1714. It should be noted that both of these features can be attached to the blade.

Figure 18:
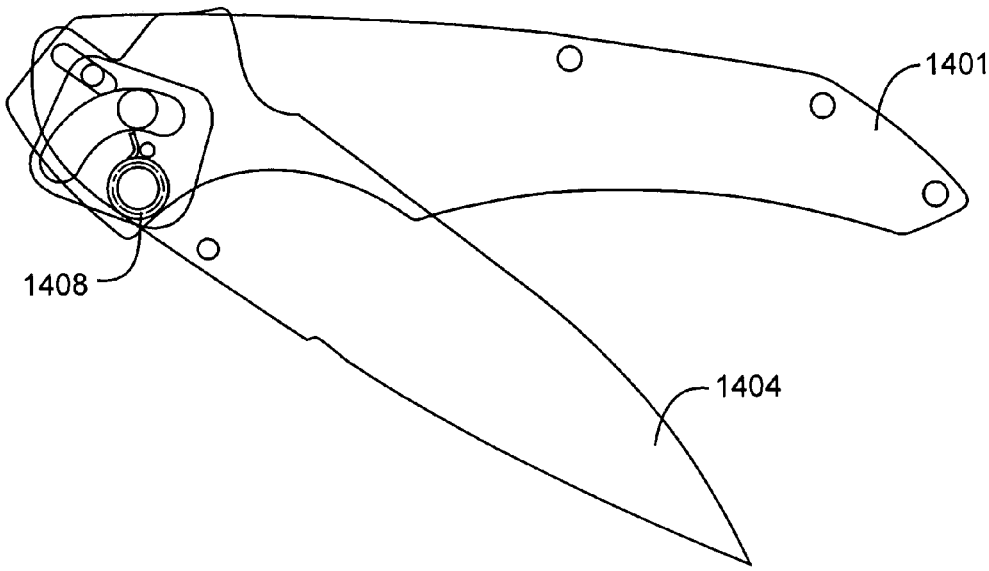
Figure 19:
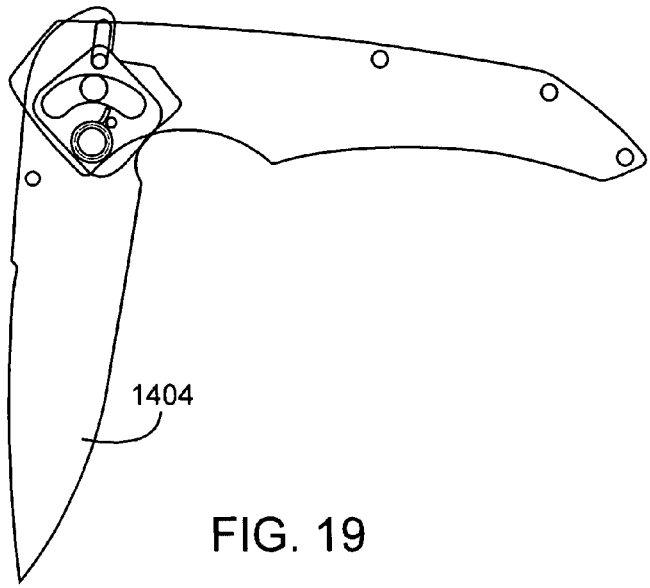
Figure 20:
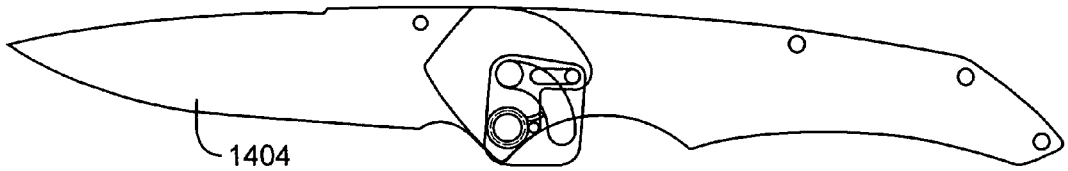

FIG. 18 illustrates the blade 1404 partially open. The potential of the torsion spring 1408 drives the crank clockwise which propels the blade 1404 in the same direction via a pin mounted on crank having an axis normal to the blade surface. FIG. 19 shows further advancement of the blade 1404 as the torsion spring 1408 drives the crank/pin through the slot in the blade. FIG. 20 shows the crank, blade and spring at the end of its travel. The torsion spring can be at its minimum potential. The pin on the crank can be at the end of the slot within the knife blade. To fully lock the blade into position, a liner lock can be used (not shown for clarity).

Thus, a number of embodiments of a spring assisted folding knife and a method of spring assist in a folding knife have been disclosed. The various embodiments do not represent an exhaustive summary of spring assisted folding knife embodiments and should not be interpreted as limiting the scope of the claims. Rather, the embodiments are provided as examples of embodiments that may be designed and built using the features and advantages disclosed herein.

What is claimed is:

1. A method for opening a blade of a folding knife, the method comprising:

applying at a closed knife an external force configured to open the blade by and moving a position of a latch cam within the blade;

and moving a position of an offset cam pin of the latch cam from within a convex extension positioned at one end of an arculate slot to substantially within the arcuate slot formed in a reference piece of the knife;

exerting an opening force configured to open the blade to a fully open position without additional external force; and wherein the step of moving the offset cam pin comprises rotating the latch cam in a direction that is opposite to a direction of rotation of the blade.

2. The method of claim 1, wherein the act of applying the opening force comprises applying a torsional force to the blade.

3. The method of claim 1, wherein the act of applying the opening force comprises applying a force to the blade using a torsional spring.

4. A folding knife comprising:

a blade having a first recess and a second recess offset from said first recess;

wherein said first recess is configured to receive a pivot pin, and the blade is configured to rotate about an axis of the pivot pin;

wherein said second recess is configured to receive a latch cam;

wherein said latch cam comprises a body and an offset pin;

wherein said latch cam body is located substantially within said second recess, and said offset pin is located substantially external to said second recess;

a spring mechanically coupled to the offset pin and configured to exert a force on the offset pin in a direction of blade opening.

5. The knife of claim 4, comprising a reference piece having an arcuate slot with a convex extension slot positioned at one end of the arcuate slot.

6. The knife of claim 5, wherein the latch cam is arranged to rotate in said blade to move the offset pin from the convex extension slot to substantially within the arcuate slot.

7. The knife of claim 5, wherein the reference piece comprises a liner.

8. The knife of claim 5, wherein the reference piece comprises a handle.

9. The knife of claim 5, wherein the offset pin is positioned substantially in the convex extension slot when the blade of the knife is rotated less than a predetermined angle.

10. The knife of claim 5, wherein the force exerted by the spring on the offset pin is substantially impeded by at least one wall of the convex extension slot.

11. The knife of claim 5, wherein the offset pin is positioned substantially in the arcuate slot when the blade of the knife is rotated greater than a predetermined angle.

12. The knife of claim 5, further comprising:

a flipper positioned on a side of the knife opposite a side from which the blade is removed, the flipper configured to receive an external force that at least partially rotates open the blade.

13. The knife of claim 12, wherein the flipper comprises a protrusion on the knife extending through the side of the knife opposite the side from which the blade is removed.

14. The knife of claim 12, wherein the blade opens substantially under the force of the spring when an edge of the flipper is flush with or above an edge of a knife handle.

15. The knife of claim 5, wherein the spring substantially rotates the blade to a fully open position when the offset pin is positioned substantially within the arcuate slot.

16. The knife of claim 4, further comprising a stud mechanically coupled to the blade and configured to receive an external force that at least partially rotates open the blade.

17. The knife of claim 4, wherein the spring comprises a torsional spring wound around a pivot axis of the blade.

18. The knife of claim 4, wherein the spring comprises:

a first spring positioned to a left of the blade; and a second spring positioned to a right of the blade.

* * * * *